US012366082B1

(12) United States Patent
Li et al.

(10) Patent No.: US 12,366,082 B1
(45) Date of Patent: Jul. 22, 2025

(54) HANDHELD SWIMMING POOL SEWAGE SUCTION MACHINE

(71) Applicant: Shenzhen Aiper Intelligent Co., Ltd., Guangdong (CN)

(72) Inventors: Yong Li, Jiangsu (CN); Peng Chen, Jiangsu (CN); Fengli Zhao, Jiangsu (CN); Fengfeng Lu, Jiangsu (CN)

(73) Assignee: SHENZHEN AIPER INTELLIGENT CO., LTD., Shenzhen (CN)

( * ) Notice: Subject to any disclaimer, the term of this patent is extended or adjusted under 35 U.S.C. 154(b) by 0 days.

(21) Appl. No.: 18/967,602

(22) Filed: Dec. 3, 2024

(30) Foreign Application Priority Data

Sep. 5, 2024 (CN) ..... 202411247078.3

(51) Int. Cl.
*E04H 4/16* (2006.01)

(52) U.S. Cl.
CPC ..... *E04H 4/1636* (2013.01); *E04H 4/16* (2013.01); *E04H 4/1654* (2013.01)

(58) Field of Classification Search
CPC ..... E04H 4/16; E04H 4/1654; E04H 4/1636; A47L 5/24; C02F 2103/42; C02F 1/001
See application file for complete search history.

(56) References Cited

U.S. PATENT DOCUMENTS 8,128,815 B1 * 3/2012 Simmons ..... A01K 63/10 210/167.16
9,016,290 B2 4/2015 Kovarik et al.
10,557,278 B2 2/2020 Hayes et al.
2006/0032801 A1 * 2/2006 Reid ..... E04H 4/1636 210/167.13
2017/0260766 A1 * 9/2017 Hui ..... A47L 9/2884
2017/0321441 A1 * 11/2017 Laydera-Collins ... E04H 4/1636
2019/0032355 A1 * 1/2019 Erlich ..... E04H 4/1636
2020/0353390 A1 * 11/2020 Roumagnac ..... B01D 39/08
2022/0112735 A1 * 4/2022 Besnier ..... E04H 4/1663
2024/0102304 A1 3/2024 Kovarik

FOREIGN PATENT DOCUMENTS

CN 101363285 B 6/2010

OTHER PUBLICATIONS

Extended European Search Report issued on May 26, 2025 for European Patent Application No. 24216721.1.

* cited by examiner

*Primary Examiner* — Michael D Jennings
(74) *Attorney, Agent, or Firm* — VOLPE KOENIG

(57) ABSTRACT

The present disclosure relates to a handheld swimming pool sewage suction machine, including a body and a suction head, the body being therein with a first water pump, a filtering device, a second water pump, a main channel and a bypass channel, the filtering device and the first water pump being at least partially located in the main channel, and the second water pump being at least partially located in the bypass channel; wherein the first water pump enables water to flow into the main channel from a first water inlet and to be discharged from a body outlet after filtration by the filtering device; and the second water pump enables the water to flow into the main channel from a second water inlet of the bypass channel when a predetermined condition is fulfilled. The handheld swimming pool sewage suction machine can start operating under different water depth conditions.

18 Claims, 4 Drawing Sheets

HANDHELD SWIMMING POOL SEWAGE SUCTION MACHINE

CROSS REFERENCE TO RELATED APPLICATIONS

The present application the benefit of Chinese Patent Application No. 202411247078.3 filed on Sep. 5, 2024, the contents of which are incorporated herein by reference in their entirety.

TECHNICAL FIELD

The present disclosure relates to the technical field of swimming pool sewage suction machines, and specifically to a handheld swimming pool sewage suction machine.

BACKGROUND

In the field of swimming pool cleaning and sewage treatment, an impeller pump has traditionally been widely used as a core power source, and the rotation of its vanes will generate a negative pressure area inside a pump body, thereby pumping surrounding water and impurities into the pump body. However, due to a fact that the impeller pump lacks a capacity of lift and the activation requirement that an impeller is necessary to be immersed in water, a sewage suction machine adopting an impeller pump is significantly limited in terms of application scenarios and shape designs. In a conventional handheld swimming pool sewage suction machine, an impeller pump is located at a high position, and in a case where a water level in a swimming pool is low, the impeller pump cannot be directly activated and pump water because the water level in the swimming pool is far away from a suction port of the impeller pump. Therefore, the conventional handheld swimming pool sewage suction machine cannot be effectively operated in a shallow end, resulting in low cleaning efficiency and the existence of cleaning blind zones.

SUMMARY OF THE DISCLOSURE

In order to solve the problem that a conventional handheld swimming pool sewage suction machine cannot operate effectively in a shallow end, resulting in low cleaning efficiency and the existence of cleaning blind zones.

The present disclosure provides a handheld swimming pool sewage suction machine comprising a body and a suction head connected thereto, the body being provided therein with a first water pump, a filtering device, a second water pump, a main channel and a bypass channel, the filtering device and the first water pump both being at least partially located in the main channel, and the second water pump being at least partially located in the bypass channel;

wherein the first water pump is capable of directing water to flow into the main channel from a first water inlet of the main channel and to be discharged from a body outlet after the water is filtered by the filtering device; and the second water pump is capable of directing the water to flow into the main channel from a second water inlet of the bypass channel when a predetermined condition is fulfilled.

Further, the second water inlet is located below the first water pump.

Further, the predetermined condition includes at least one of the following situations:

i) A control circuit of the second pump receives a first signal indicating that a water level in a swimming pool or a water level in the main channel is less than a first threshold;

ii) The control circuit of the second water pump receives a power-on signal from the handheld swimming pool sewage suction machine or a second signal indicating that the second water pump is activated; and iii) It is detected by the control circuit of the second water pump detects that an operating current of the first water pump is less than a second threshold or that an impeller of the first water pump is not immersed in the water.

Further, the first threshold is within a range of from 0.1 m to 0.5 m.

Further, the main channel is provided with a level sensor, and the first signal is generated by the level sensor.

Further, the first water inlet is communicated with a suction port of the suction head.

Further, the second water inlet is provided proximate to the second water pump.

Further, the filtering device is removably connected to the body.

Further, the second water pump is shut down when at least one of the following conditions is fulfilled:

a) The water level in the swimming pool or the water level in the main channel is higher than the first threshold;

b) The handheld swimming pool sewage suction machine operates for a first predetermined period of time or the second pump operates for a second predetermined period of time; and c) It is detected that the operating current of the first water pump is greater than the second threshold or that the impeller of the first water pump is at least partially immersed in water.

Further, a sealed channel is formed between the bypass passage and the main channel.

Embodiments of the present disclosure has the following beneficial effects.

The second water pump provided in the present disclosure is connected to the main channel through the bypass channel, and in a case where the handheld swimming pool sewage suction machine is in a shallow end, the second water pump draws water in advance to raise the water level in the main channel, so that the first water pump can draw water smoothly and the handheld swimming pool sewage suction machine can directly draw water from the shallow end, which expands the operating range of the handheld swimming pool sewage suction machine and renders the handheld swimming pool sewage suction machine can be activated under different water depth conditions, thereby improving operational flexibility and application scope, and improving the cleaning efficiency.

BRIEF DESCRIPTION OF THE DRAWINGS

In order to more clearly illustrate the technical solutions of the present disclosure, the following description will briefly introduce the accompanying drawings that need to be used in the description of embodiments of the present disclosure or the prior art. Obviously, the accompanying drawings in the following description are only some of the embodiments of the present disclosure, and other drawings may be obtained from these drawings by those skilled in the art without creative labor.

Figure 1:
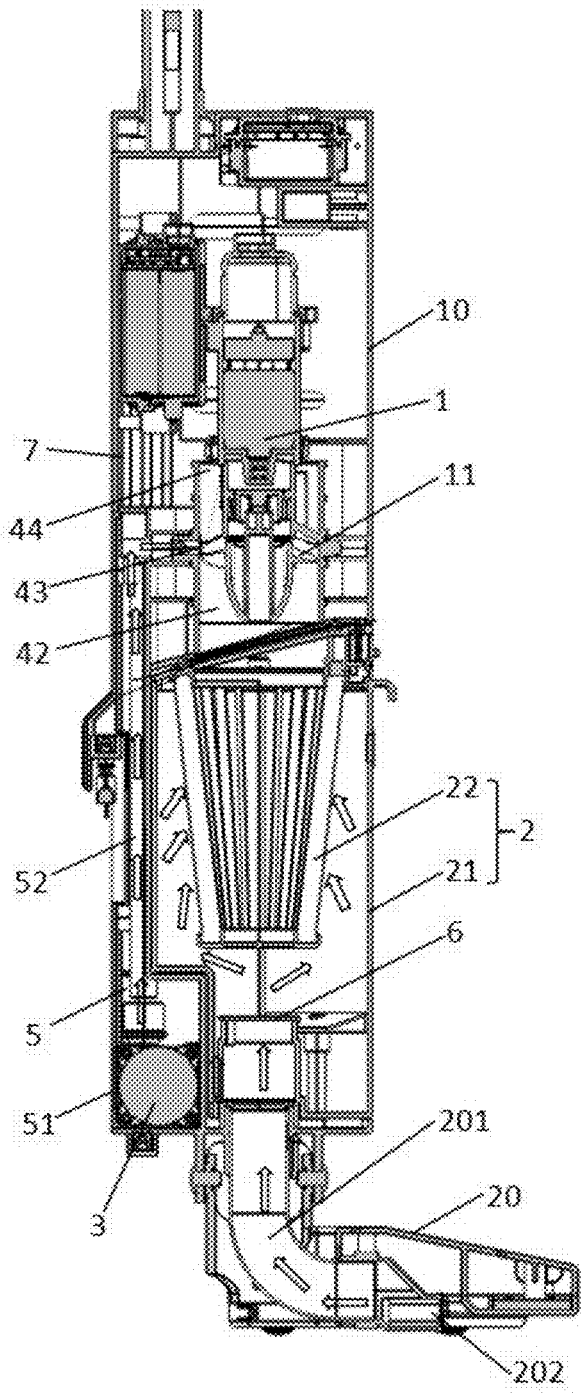
FIG. 1 is a cross-sectional view of a handheld swimming pool sewage suction machine according to an embodiment of the present disclosure.

Reference signs: body 10, suction head 20, suction channel 201, suction port 202, first water pump 1, impeller 11, filtering device 2, dust collection box 21, dust collection box inlet 211, filtering member 22, second water pump 3, main channel 4, first water inlet 41, accommodation chamber 42, third water inlet 43, main water outlet 44, bypass channel 5, second water inlet 51, connecting pipe 52, one-way valve 6, and body outlet 7.

DETAILED DESCRIPTION

The technical solutions in embodiments of the present disclosure will be described clearly and completely in the following in conjunction with the accompanying drawings in the embodiments of the present disclosure, and it is obvious that the described embodiments are only a part of the embodiments of the present disclosure and not all of them. Based on the embodiments in the present disclosure, all other embodiments obtained by those skilled in the art without making creative labor shall fall within the scope of protection of the present disclosure.

In the description of the present disclosure, it is to be understood that the terms "above, below, inside, outside, top, bottom" and the like indicate an orientation or positional relationship based on that shown in the accompanying drawings, or with respect to a component itself in the vertical, perpendicular, or gravitational direction, and they are intended solely for the purpose of facilitating the description of the present disclosure and to simplify the description, and do not indicate or imply an involved device or component to must have a particular orientation, or to be constructed and operated in a particular orientation. Therefore, the terms are not to be construed as a limitation of the present disclosure. The term "first", "second", or the like, is used only for descriptive purposes and is not to be understood as indicating or implying relative importance or implicitly specifying the number of technical features indicated. Thus, a feature defined with the term "first", "second", or the like, may expressly or impliedly include one or more such features.

Unless otherwise defined, technical and scientific terms used herein have the same meaning as commonly understood by those skilled in the art of the field to which the present disclosure belongs. Terms used herein are intended to describe specific embodiments only and are not intended to limit the present disclosure. As used herein, the terms "part", "component" and the like may denote either a single part or a combination of parts.

As used herein, the terms "installation", "setup", "connection" and the like should be broadly understood, for example, they can be fixed connections, detachable connections, or integrated connections; or, they can be mechanical connections or electrical connections; or they can indicate that one component is directly attached to another component, that one component is attached to another component through middleware, or that there is a connection within two components. For those skilled in the art, the specific meanings of the above terms in the present disclosure can be understood on a case-by-case basis. A feature described in one embodiment of the present disclosure can be applied alone or in combination with other features to another embodiment, unless the feature is not applicable in that another embodiment or otherwise specified.

Figure 2:
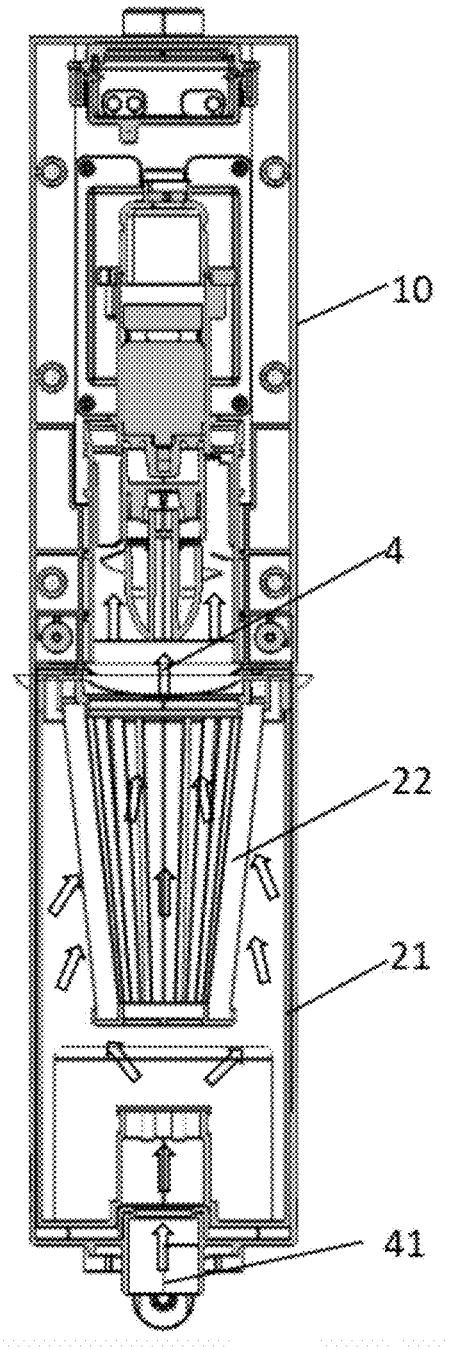
FIG. 2 is a schematic diagram illustrating a flow direction of water in a main channel according to an embodiment of the present disclosure.
Figure 3:
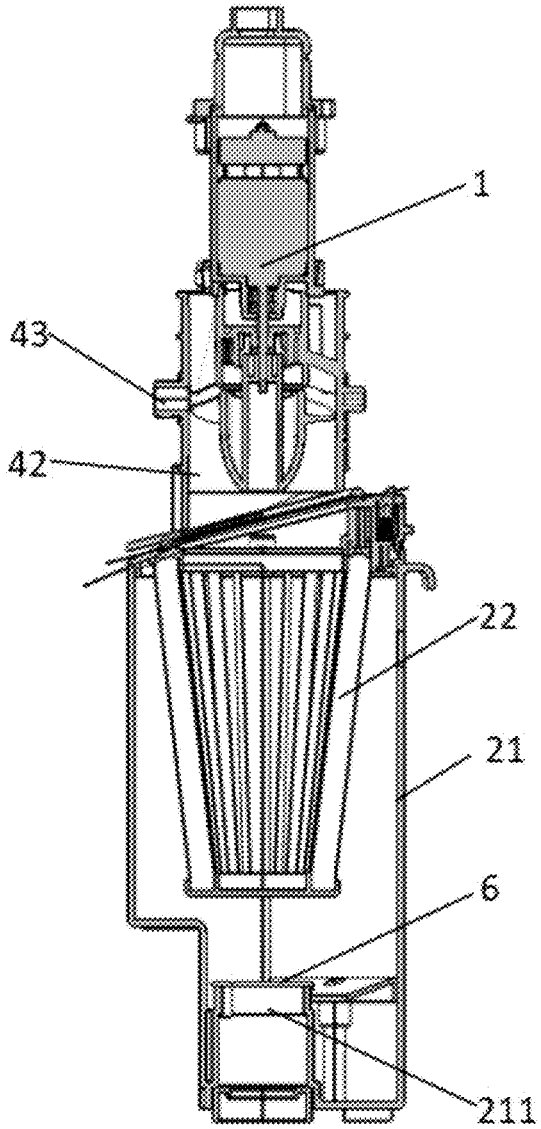
FIG. 3 is a cross-sectional view of a first water pump and a filtering device according to an embodiment of the present disclosure.
Figure 4:
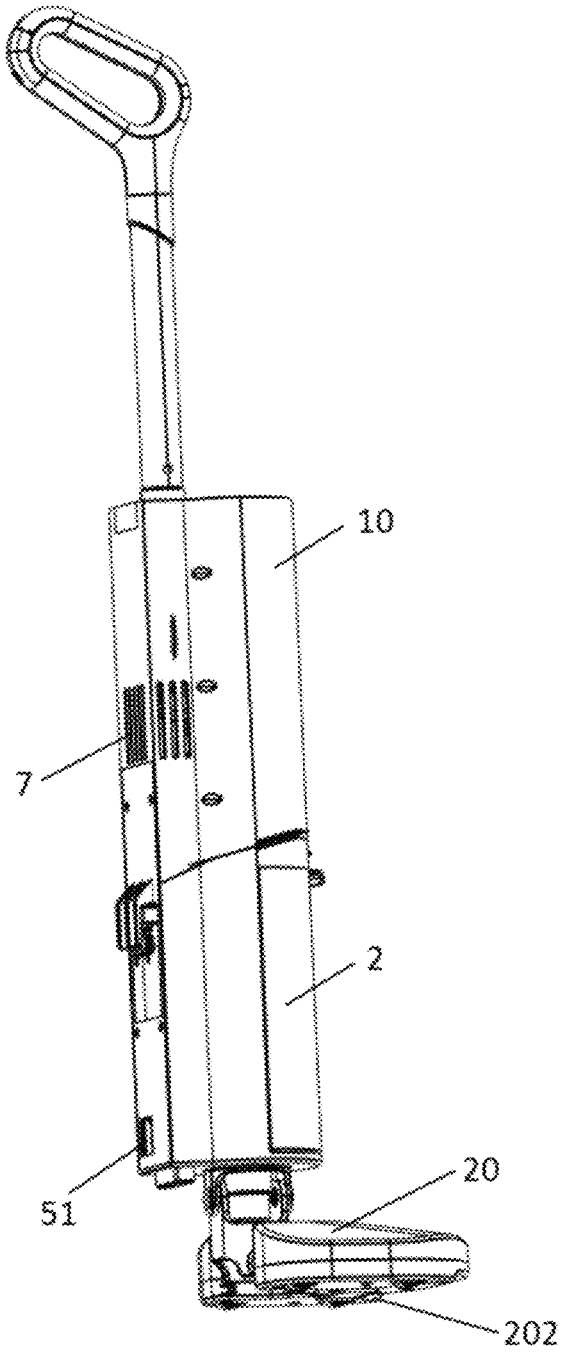
FIG. 4 is a schematic structure diagram of a handheld swimming pool sewage suction machine according to an embodiment of the present disclosure.

Referring FIG. 1 to FIG. 4, a handheld swimming pool sewage suction machine provided in an embodiment of the present disclosure is described. The handheld swimming pool sewage suction machine comprises a body 10 and a suction head 20 connected thereto. The body 10 is provided therein with a first water pump 1, a filtering device 2, a second water pump 3, a main channel 4, and a bypass channel 5. Both the filtering device 2 and the first water pump 1 are at least partially disposed in the main channel 4, and the second water pump 3 is at least partially disposed in the bypass channel 5.

The first water pump 1 is capable of directing water to flow into the main channel 4 from a first water inlet 41 of the main channel 4 and to be discharged from a body outlet 7 after the water is filtrated by the filtering device 2.

The second water pump 3 is capable of directing the water to flow into the body 10 from a second water inlet 51 of the bypass channel 5 when a predetermined condition is fulfilled.

Specifically, the first water pump 1 is disposed above the filtering device 2. The main channel 4 is a main path of the swimming pool water circulation. The first water pump 1 pumps the pool water into the main channel 4 from the first inlet 41 at a bottom of the body 10, and then discharges the pool water from the body outlet 7 after the pool water is filtered by the filtering device 2.

In one possible embodiment, the first water pump 1 is an impeller pump, which is characterized by a high flow rate and high efficiency. However, the impeller pump has no capacity of lift, and its impeller 11 needs to be immersed in water in order to start operating, so it cannot be suitable for operating in a shallow end. In order to ensure that the impeller 11 of the first water pump 1 contacts the pool water to start operating, a second water pump 3 is provided to pump water from a swimming pool and convey the water into the main channel 4 through the bypass channel 5, so as to provide conditions for the activation of the first water pump 1.

The second water pump 3 is mounted at a bottom of the body 10 or a lower position. In one possible embodiment, the second water pump 3 may be a submersible pump with a lift distance of greater than 0.5 m, and it thus is adaptable to a working condition of a shallow end with a depth of 0.3 m and less, with high pumping efficiency and low operating noise.

In this embodiment, the second water pump 3 is located at a lower position and connected to the main channel 4 through the bypass channel 5, and in a case where the handheld swimming pool sewage suction machine is in a shallow end, the second water pump 3 pumps water in advance to raise a water level of the main channel 4, so that the first water pump 1 can pump water smoothly, and thus the handheld swimming pool sewage suction machine can directly draw water from the shallow end. This extends the operating range of the handheld swimming pool sewage suction machine, and makes the handheld swimming pool sewage suction machine activate under different water depth conditions, thereby improving operational flexibility and cleaning efficiency, and extending the scope of application.

Further, a sealed channel is formed between the bypass channel 5 and the main channel 4. Specifically, the bypass channel 5 is provided with a connecting pipe 52, and a water outlet of the second water pump 3 is connected to the main channel 4 through the connecting pipe 52.

Further, the second water inlet 51 is provided proximate to the second water pump 3. In one possible embodiment, the second water inlet 51 is a separate water inlet, which is provided proximate to the second water pump 3 to facilitate pumping of water by the second water pump 3. Specifically, the second water inlet 51 is provided on an outer wall surface of the body 10, and is communicated with a water inlet of the second water pump 3.

Further, the second water inlet 51 is located below the first water pump 1. The second water inlet 51 is disposed on the outer wall surface of the body 10, and the second water inlet 51 at a lower position is easier to contact the water level of the shallow end, which facilitates the activation and operation of the second water pump 3 and is conducive to enhancing the operation capability of the handheld swimming pool sewage suction machine in the shallow end. Preferably, the second water inlet 51 is located below the first water pump 1 and above the suction head 20, and the second water pump 3 pumps water through the separate second water inlet 51, so that the second water pump 3 can effectively pump water in the shallow end as well, and direct contact with the dirt and impurities deposited on the bottom of the swimming pool is also effectively avoided.

Further, the main channel 4 is provided therein with an accommodation chamber 42, and a third water inlet 43 is provided on a side wall of the accommodation chamber 42 and communicated with the water outlet of the second water pump 3 via the connecting pipe 52. The impeller 11 of the first water pump 1 is provided in the accommodation chamber 42.

Further, the accommodation chamber 42 is provided with a main water outlet 44, and the main water outlet 44 is communicated with the outer wall surface of the body 10 to form the body outlet 7.

The filtering device 2 includes a dust collection box 21 and a filtering member 22, and the filtering member 22 is disposed in the dust collection box 21. The accommodation chamber 42 is communicated with an inner cavity of the filtering member 22. In this embodiment, the water flowing into the filtering device 2 is filtered by the filtering member 22, and then discharged through the main water outlet 44 of the accommodation chamber 42 and the body outlet 7. A dust collection box inlet 211 is provided at a bottom of the dust collection box 21, which is communicated with the first water inlet 41.

Further, the filtering device 2 is removably connected to the body 10. The filtering device 2 may be removably connected to the body 10 through a connection including and not limited to a clasp connection and a threaded connection. In one possible embodiment, the dust collection box 21 is provided as a front disassembly type. The body 10 is provided with at least one mounting structure, and an edge of the dust collection box 21 is provided with a mounting fit structure correspondingly. For assembly, the mounting fit structure of the dust collection box 21 is aligned with the mounting structure of the body 10, and the dust collection box 21 is pushed forward until the mounting structure is snapped with the mounting fit structure so as to realize a solid connection. For disassembly, it can be achieved by pressing a button provided on the dust collection box 21 or the body 10 or by directly pulling outwardly the dust collection box 21. The mounting structure and the mounting fit structure include and are not limited to a connection between a snap slot and a snap projection or between a snap hook slot and a snap hook. Removable connection between the filtering device 2 and the body 10 facilitates a user to easily remove the filtering member for cleaning, thereby reducing the difficulty of maintenance and improving the convenience of cleaning work.

Further, the filter member 22 includes a pleated filter screen. The filter member 22 adopts a design of a pleated filter screen, which increases surface area of the filter screen and improves the filtration efficiency and capacity. The pleated filter screen can more effectively capture and intercept impurities and particulate matter in water flow, ensuring cleaned water clearer. At the same time, the pleated filter screen also has a certain degree of elasticity and toughness, which can resist a certain degree of water flow impact and mechanical vibration, prolonging the service life of the filtering member 22. In one possible embodiment, the pleated filter screen is a Hepa filter screen.

Further, the first water inlet 41 is connected to a suction port 202 of the suction head 20. Specifically, the suction head 20 includes a suction channel 201 and a suction port 202, and the first water inlet 41 is communicated with the suction port 202 via the suction channel 201. The suction port 202 is provided at a bottom of the suction head 20. In one possible embodiment, a one-way valve 6 is provided between the suction channel 201 and the dust collection box 21. The one-way valve 6 is configured to prevent sewage in the dust collection box 21 from flowing back into the suction channel 201 when the handheld swimming pool sewage suction machine is not in operation. Preferably, the one-way valve 6 is provided on a dust collection box inlet port 211.

Further, the predetermined condition, which is fulfilled so that the second water pump 3 is capable of directing the water to flow into the main channel 4 from the second water inlet 51 of the bypass channel 5, includes at least one of the following situations.

i) A control circuit of the second pump 3 receives a first signal indicating that a water level in the swimming pool or a water level in the main channel 4 is lower than a first threshold. When it is detected by a level sensor that the water level in the swimming pool or the water level in the main channel 4 is lower than the predetermined first threshold, it indicates that the current water level in the main channel 4 does not satisfy an activation condition of the first water pump 1, and therefore the first signal capable of triggering the activation of the second water pump 3 is generated.

ii) The control circuit of the second water pump 3 receives a power-on signal from the handheld swimming pool sewage suction machine or a second signal indicating that the second water pump 3 is activated. When the control circuit of the second water pump 3 receives a power-on signal indicating that the handheld swimming pool sewage suction machine is activated or a signal explicitly indicating that the second water pump 3 needs to be activated, i.e., the second signal, the control circuit will directly drive the second water pump 3 into an operating state to ensure that the water level in the main channel 4 can reach a water level required for activating the first water pump 1.

iii) It is detected by the control circuit of the second water pump 3 that an operating current of the first water pump 1 is less than a second threshold or that the impeller of the first water pump 1 is not immersed in the water. The second water pump 3 also has an intelligent monitoring function, i.e., the second water pump 3 can detect that the operating current of the first water pump 1 is lower than the predetermined second threshold or that the impeller of the first water pump 1 is not immersed in water. Once these conditions are detected, it is indicated that the current water level of the main channel 4 is not sufficient to support the operation of the first water pump 1, and additional water flow is needed, and thereupon the control circuit controls the activation of the second water pump 3 in order to maintain the stable operation of the handheld swimming pool sewage suction machine. Specifically, the control circuit monitors the operating current of the first water pump 1 in real time through a detection device, such as a current sensor, and compare the operating current with the predetermined second threshold, or alternatively, the control circuit indirectly or directly determines whether the impeller is immersed in the water through a variety of sensors, such as a water level sensor and a pressure sensor, or through an image recognition technology.

Further, the first threshold is in a range of from 0.1 m to 0.5 m. Optionally, the first threshold is in a range of from 0.2 m to 0.5 m. Preferably, the first threshold is 0.2 m, 0.3 m, or 0.4 m. The first threshold in this this embodiment is determined in accordance with the pumping performance of the first water pump 1, the layout of the main channel and the bypass channel, and the minimum water level requirement of the swimming pool in an integrated manner. Usually, by testing the water pumping efficiency of the first water pump 1 at different water levels, the minimum water level that can ensure the effective operation of the first water pump 1 and maximize the use of the second water pump 3 to raise the water level is determined as the first threshold.

Further, the level sensor is provided within the main channel 4, and the first signal is generated by the level sensor. Specifically, the level sensor is installed in an appropriate location within the main channel 4 or within the swimming pool for real-time monitoring of water level changes. When the water level in the swimming pool or the water level in the main channel 4 drops to less than the first threshold, the level sensor outputs the first signal to a control system of the handheld swimming pool sewage suction machine, and accordingly the control system controls the activation of the second water pump 3. In one possible embodiment, the level sensor is provided within the dust collection box 21 or the filtering member 22. The level sensor includes and is not limited to a float level sensor, a capacitive level sensor and an ultrasonic level sensor.

In this embodiment, the second threshold is the lower limit of a normal range of the operating current of the first water pump 1. The determination of the second threshold is based on the rated current of the motor of the first water pump and the actual operating efficiency. When the operating current of the first water pump 1 is lower than the second threshold, it usually means that the first water pump 1 is not sufficiently immersed in water or the water flow is insufficient.

Further, the second water pump 3 is shut down when at least one of the following conditions is fulfilled.

a) The water level in the swimming pool or the water level in the main channel 4 is higher than the first threshold. When the level sensor detects that the water level in the swimming pool or the water level in the main channel 4 is higher than the first threshold, it indicates that the water level in the swimming pool or the water level in the main channel 4 meets the activation condition of the first water pump 1, the level sensor thus outputs a signal to the control system of the handheld swimming pool sewage suction machine, and the second water pump 3 is shut down accordingly.

b) The handheld swimming pool sewage suction machine operates for a first predetermined period of time or the second pump 3 operates for a second predetermined period of time. When the handheld swimming pool sewage suction machine is activated and continuously operates for the first predetermined period of time, the second water pump 3 is controlled to stop working. When the second water pump 3 is activated due to a fact that the water level in the swimming pool is insufficient, that the water level in the main channel 4 is insufficient, that the operating current of the first water pump 1 is less than the second threshold, or that the impeller of the first water pump 1 is detected as not being immersed in the water, the second water pump 3 will be automatically shut down after continuously operating for the second predetermined period of time, so as to avoid energy consumption and wear and tear caused by excessive operation.

In this embodiment, by testing the water level changes in the filtering device 2 during different periods of time after the handheld swimming pool sewage suction machine is activated, the shortest time for the water level in the filtering device 2 to reach the required water level for the first water pump 1 to activate is found and determined as the first predetermined period of time. After the handheld swimming pool sewage suction machine is activated and operates for the first predetermined period of time, the water level in the filtering device 2 is stable and sufficient to support the normal operation of the first water pump 1. The second predetermined period of time is the maximum allowable period time for the second water pump 3 to continuously operate under specific abnormal conditions. After the second water pump 3 continuously operates for the maximum allowable period time under these abnormal conditions, if the second water pump 3 continues to operate, it may not only fail to provide sufficient water flow to the filtering device 2, but also be overheated or worn out or even be damaged due to lack of sufficient water flow for cooling or lubrication.

c) It is detected that the operating current of the first water pump 1 is greater than the second threshold or that the impeller of the first water pump 1 is at least partially immersed in the water. If it is detected that the operating current of the first water pump 1 returns to the normal level, that is, the operating current is greater than the second threshold, or it is confirmed that the impeller of the first water pump has been completely immersed in the water or partially immersed in the water, it indicates that the flow of water in the main channel is sufficient and stable, and at this time, the second water pump 3 is automatically shut down.

In this embodiment, with the auxiliary role of the second water pump 3, the first water pump 1 is enabled to activate normally, which solves the problem that the first water pump 1 is unable to directly pump water in a shallow end, and by intelligently regulating the activation and inactivation of the second water pump 3, the stability of the water level in the main channel 4 can be ensured, so that the first water pump 1 always operates in the optimal working condition, thereby improving the cleaning efficiency of the entire swimming pool, enhancing the overall stability and reliability of the handheld swimming pool sewage suction machine, and improving the degree of automation of the handheld swimming pool sewage suction machine. By accurately determining when to activate the second water pump 3, unnecessary energy waste is avoided, and by adjusting parameters such as the first threshold, the handheld swimming pool sewage suction machine can be flexibly applied to pool cleaning scenarios, such as different sizes of swimming pools and different water level conditions.

Obviously, the above-described embodiments are only part, not all, of the embodiments of the present disclosure. Based on the embodiments of the present disclosure, those skilled in the art may make other different forms of modifications or variations without making creative labor, all of which should fall within the scope of protection of the present disclosure.

Other embodiments, other than the embodiments of the present disclosure, will readily come to mind to those skilled in the art upon consideration of the specification and practice of the embodiments disclosed herein.

The specification is intended to cover any variations, uses, or adaptations of the embodiments of the present disclosure that follow the general principles of the embodiments of the present disclosure and include common knowledge or means of customary skill in the art not disclosed by the embodiments of the present disclosure. The specification and the embodiments are to be regarded as exemplary only, and the true scope and spirit of the embodiments of the present disclosure are indicated by the following claims.

It should be understood that the embodiments of the present disclosure are not limited to the embodiments that has been described above and illustrated in the accompanying drawings, and are subject to various modifications and changes without departing from the scope of the present disclosure. The scope of the present disclosure is limited only by the appended claims.

The invention claimed is:

1. A handheld swimming pool sewage suction machine, comprising a body (10) and a suction head (20) connected thereto, the body (10) being provided therein with a first water pump (1), a filtering device (2), a second water pump (3), a main channel (4) and a bypass channel (5), both the filtering device (2) and the first water pump (1) being at least partially disposed in the main channel (4), and the second water pump (3) being at least partially located in the bypass channel (5);

wherein the first water pump (1) is configured to direct water through an impeller of the first water pump to flow into the main channel (4) from a first water inlet (41) of the main channel (4) and to be discharged from a body outlet (7) after the water is filtrated by the filtering device (2); and the second water pump (3) is configured to direct water through an impeller of the second water pump to flow into the main channel (4) from a second water inlet (51) of the bypass channel (5) when a predetermined condition is fulfilled.

2. The handheld swimming pool sewage suction machine according to claim 1, wherein the second water inlet (51) is located below the first water pump (1).

3. The handheld swimming pool sewage suction machine according to claim 2, wherein the second water inlet (51) is provided proximate to the second water pump (3).

4. The handheld swimming pool sewage suction machine according to claim 3, wherein a sealed channel is formed between the bypass channel (5) and the main channel (4).

5. The handheld swimming pool sewage suction machine according to claim 2, wherein a sealed channel is formed between the bypass channel (5) and the main channel (4).

6. The handheld swimming pool sewage suction machine according to claim 1, wherein the predetermined condition includes at least one of following situations:

i) A control system receives a first signal indicating that a water level in a swimming pool or a water level in the main channel (4) is less than a first threshold;

ii) The control system receives a power-on signal from the handheld swimming pool sewage suction machine or a second signal indicating that the second water pump (3) is activated; and iii) The control system receives a signal indicating that an operating current of the first water pump (1) is less than a second threshold or that an impeller of the first water pump (1) is not immersed in the water.

7. The handheld swimming pool sewage suction machine according to claim 6, wherein the first threshold is in a range of from 0.1 m to 0.5 m.

8. The handheld swimming pool sewage suction machine according to claim 7, wherein a sealed channel is formed between the bypass channel (5) and the main channel (4).

9. The handheld swimming pool sewage suction machine according to claim 6, wherein the main channel (4) is provided with a level sensor, and the first signal is generated by the level sensor.

10. The handheld swimming pool sewage suction machine according to claim 9, wherein a sealed channel is formed between the bypass channel (5) and the main channel (4).

11. The handheld swimming pool sewage suction machine according to claim 6, wherein the second water pump (3) is shut down when at least one of following conditions is fulfilled:

a) The control system receives a signal indicating that the water level in the swimming pool or the water level in the main channel (4) is higher than the first threshold;

b) The control system receives a signal indicating that the handheld swimming pool sewage suction machine operates for a first predetermined period of time or that the second pump (3) operates for a second predetermined period of time; and c) The control system receives a signal indicating that the operating current of the first water pump (1) is greater than the second threshold or that the impeller of the first water pump (1) is at least partially immersed in the water.

12. The handheld swimming pool sewage suction machine according to claim 11, wherein a sealed channel is formed between the bypass channel (5) and the main channel (4).

13. The handheld swimming pool sewage suction machine according to claim 6, wherein a sealed channel is formed between the bypass channel (5) and the main channel (4).

14. The handheld swimming pool sewage suction machine according to claim 1, wherein the first water inlet (41) is communicated with a suction port (202) of the suction head (20).

15. The handheld swimming pool sewage suction machine according to claim 14, wherein a sealed channel is formed between the bypass channel (5) and the main channel (4).

16. The handheld swimming pool sewage suction machine according to claim 1, wherein the filtering device (2) is removably connected to the body (10).

17. The handheld swimming pool sewage suction machine according to claim 16, wherein a sealed channel is formed between the bypass channel (5) and the main channel (4).

18. The handheld swimming pool sewage suction machine according to claim 1, wherein a sealed channel is formed between the bypass channel (5) and the main channel (4).

* * * * *